US005479242A

United States Patent [19]

Sato et al.

[11] Patent Number: 5,479,242

[45] Date of Patent: Dec. 26, 1995

[54] FAN SYSTEM FOR ELECTROPHOTOGRAPHIC APPARATUS

[75] Inventors: Tsutomu Sato; Tomoyuki Nishikawa, both of Tokyo, Japan

[73] Assignee: Asahi Kogaku Kogyo Kabushiki Kaisha, Tokyo, Japan

[21] Appl. No.: 278,497

[22] Filed: Jul. 21, 1994

[30] Foreign Application Priority Data

Jul. 23, 1993 [JP] Japan ..... 5-044659 U

[51] Int. Cl.[6] ..... G03G 21/00

[52] U.S. Cl. ..... 355/215; 355/285; 355/309

[58] Field of Search ..... 355/200, 215, 355/282, 285, 210, 298, 308, 309

[56] References Cited

U.S. PATENT DOCUMENTS

| | | | |
|---|---|---|---|
| 4,154,521 | 5/1979 | Tanaka | 355/215 |
| 4,202,618 | 5/1980 | Waschk et al. | 355/215 X |
| 4,264,190 | 4/1981 | Tsuda et al. | 355/298 X |
| 4,693,588 | 9/1987 | Yarbrough et al. | 355/282 |
| 5,028,959 | 7/1991 | Gooray | 355/215 |
| 5,038,170 | 8/1991 | Serita | 355/200 |
| 5,038,174 | 8/1991 | Kato et al. | 355/215 |
| 5,073,796 | 12/1991 | Suzuki et al. | 355/215 |
| 5,132,731 | 7/1992 | Oda | 355/215 |
| 5,307,132 | 4/1994 | Tsuchiya | 355/215 X |
| 5,325,158 | 6/1994 | Guelfo et al. | 355/215 |

*Primary Examiner*—Sandra L. Brase
*Attorney, Agent, or Firm*—Sandler Greenblum & Bernstein

[57] ABSTRACT

A fan system, for an electrophotographic apparatus, is provided to simultaneously induce air flow over or through at least two components of the electrophotographic apparatus. The components may include an image forming device and an image fixing device. The fan system, which may include a fan for generating an upstream air flow and a downstream air flow, may be arranged such that a first component is disposed in the upstream air flow and a second component is disposed in the downstream air flow.

23 Claims, 3 Drawing Sheets

FAN SYSTEM FOR ELECTROPHOTOGRAPHIC APPARATUS

BACKGROUND OF THE INVENTION

The present invention relates to a fan system used in an electrophotographic apparatus such as a laser beam printer.

Conventionally, an electrophotographic printer has functional elements including at least a development unit for developing a latent image on a photoconductive drum, a transfer unit for transferring a toner image to a sheet, and a fixing unit, comprising a heat roller and a pressure roller, for fixing a toner image to a sheet. Additionally, an electrophotographic printer will conventionally have an electronic controller to control the described functional elements.

In the normal operation of the electrophotographic apparatus, some of the functional elements generate heat. Overheating of certain elements of the electrophotographic apparatus may damage those elements or other nearby parts. Thus, the apparatus will commonly have a cooling fan system to cool each of the heat-generating elements.

For example, the fixing unit commonly includes a heat roller and a pressure roller near each other. If the heat roller in the fixing unit overheats, a rubber layer covering the nearby pressure roller may deform. Furthermore, if the ambient temperature becomes high due to the heat roller, a sheet positioned near the fixing unit may also deform. The heat roller itself may suffer some damage. Therefore an individual cooling fan is often dedicated to cool the heat roller.

The electronic components in the controller also generate heat, and the controller is therefore also susceptible to damage from self-generated heat. Normally, an additional individual cooling fan is dedicated to cool the controller.

Additionally, an electrophotographic printer may have a system to remove ozone generated by the transfer unit. An ozone filter and a dedicated exhaust fan are commonly used to remove ozone.

Thus, a conventional electrophotographic printer is provided with several dedicated fans, each taking up space, consuming electrical current, generating noise, and having a certain cumulative part cost.

SUMMARY OF THE INVENTION

It is therefore an object of the present invention to provide an improved fan system for an electrophotographic apparatus that reduces the number of fans required, and allows the manufacture of a compact, low-noise, low power consumption and low-cost printer.

According to the present invention, an electrophotographic apparatus includes a fan system for simultaneously inducing air flow over or through at least two components of the electrophotographic apparatus. The set of possible components of the electrophotographic apparatus includes at least a mechanism for forming an image on a sheet and a mechanism for fixing the image onto the sheet. The fan system includes a fan for generating an upstream air flow and a downstream air flow, wherein the fan is arranged such that a first component from a set of possible components is disposed in the upstream air flow, and a second component form the set of possible components is disposed in the downstream air flow, so that the fan system simultaneously induces air flow over or through both of the first and second components.

According to another aspect of the present invention, an electrophotographic apparatus includes a mechanism for forming an image on a sheet, a mechanism for fixing the image onto the sheet, a sheet feed path for guiding a sheet through the image forming and fixing mechanism, a sheet feeding device positioned to feed a sheet along the sheet feed path, and a filter for removing a byproduct generated by a component of the electrophotographic apparatus. The fan system includes a fan for generating an upstream air flow and a downstream air flow, wherein the fan is arranged such that the sheet feeding device is disposed in the upstream air flow and the filter is disposed in the downstream air flow. Thus, the fan system simultaneously induces air flow over or through both the sheet feeding device and the filter.

According to still another aspect of the present invention, and electrophotographic apparatus includes a mechanism for forming an image on a sheet, a mechanism for fixing the image onto the sheet, a sheet feed path for guiding a sheet through the image forming and fixing mechanisms, and a sheet feeding device disposed to feed a sheet along the sheet feed path. The fan system includes a fan for generating an upstream air flow and a downstream air flow, wherein the fan is arranged such that the sheet feeding device is disposed in the upstream air flow and the image fixing means is disposed in the downstream air flow. Thus, the fan system simultaneously induces air flow over or through both the sheet feeding device and the image fixing mechanism.

According to yet another aspect of the present invention, an electrophotographic apparatus includes a mechanism for forming an image on a sheet, a mechanism for fixing the image onto the sheet, a controller for controlling the image forming mechanism and the image fixing mechanism, and a filter for removing a byproduct generated by a component of the electrophotographic apparatus. The fan system includes a fan for generating an upstream air flow and a downstream air flow, wherein the fan is arranged such that the controller is disposed in the upstream air flow and the filter is disposed in the downstream air flow. Thus, the fan system simultaneously induces air flow over or through both the controller and the filter.

According to a yet still further aspect of the present invention, an electrophotographic apparatus includes a mechanism for forming an image on a sheet, a mechanism for fixing the image onto the sheet, and a controller for controlling the image forming mechanism and the image fixing mechanism. The fan system includes a fan for generating an upstream air flow and a downstream air flow, wherein the fan is arranged such that the controller is disposed in the upstream air flow and the image fixing mechanism is disposed in the downstream air flow. Thus, the fan system simultaneously induces air flow over or through both the controller and the image fixing mechanism.

Optionally, if a filter is disposed in the downstream air flow, an ozone-generating image forming mechanism may be disposed in a location adjacent to the downstream air flow path and before the filter along the downstream air flow path. Ozone-bearing air is induced to flow over or through the image forming mechanism, and is induced to enter the downstream air flow by virtue of the proximity of the image forming mechanism to the downstream air flow and the generation of a low air pressure region (which has lower than ambient air pressure) in the downstream air flow. The ozone-bearing downstream air flow then passes through the filter, which may be an ozone filter.

DESCRIPTION OF THE ACCOMPANYING DRAWINGS

DESCRIPTION OF THE EMBODIMENTS

With reference to the drawings, three embodiments of the present invention are described.

Figure 1:
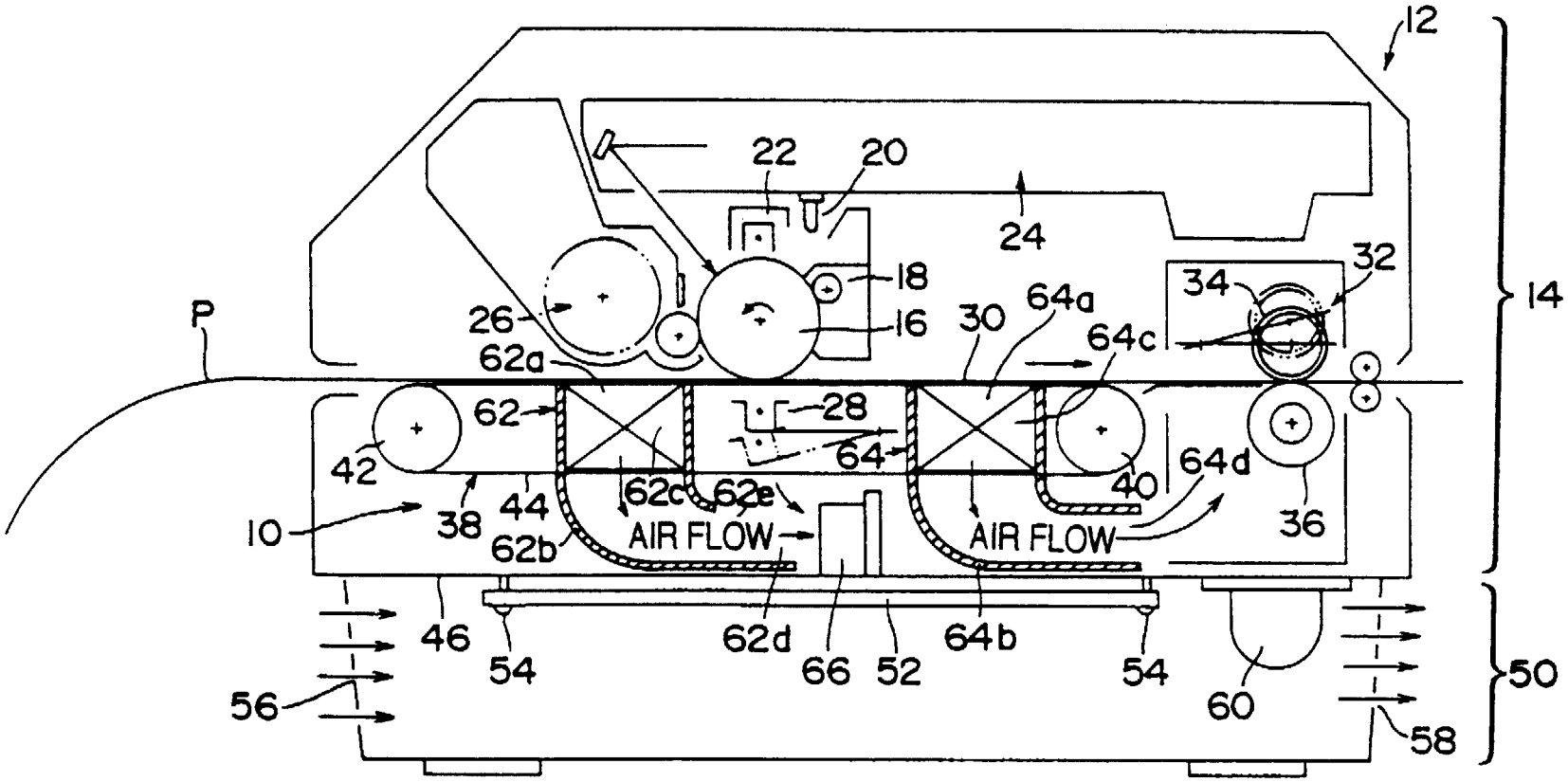
FIG. 1 is a side view of a first embodiment of the present invention.
Figure 2:
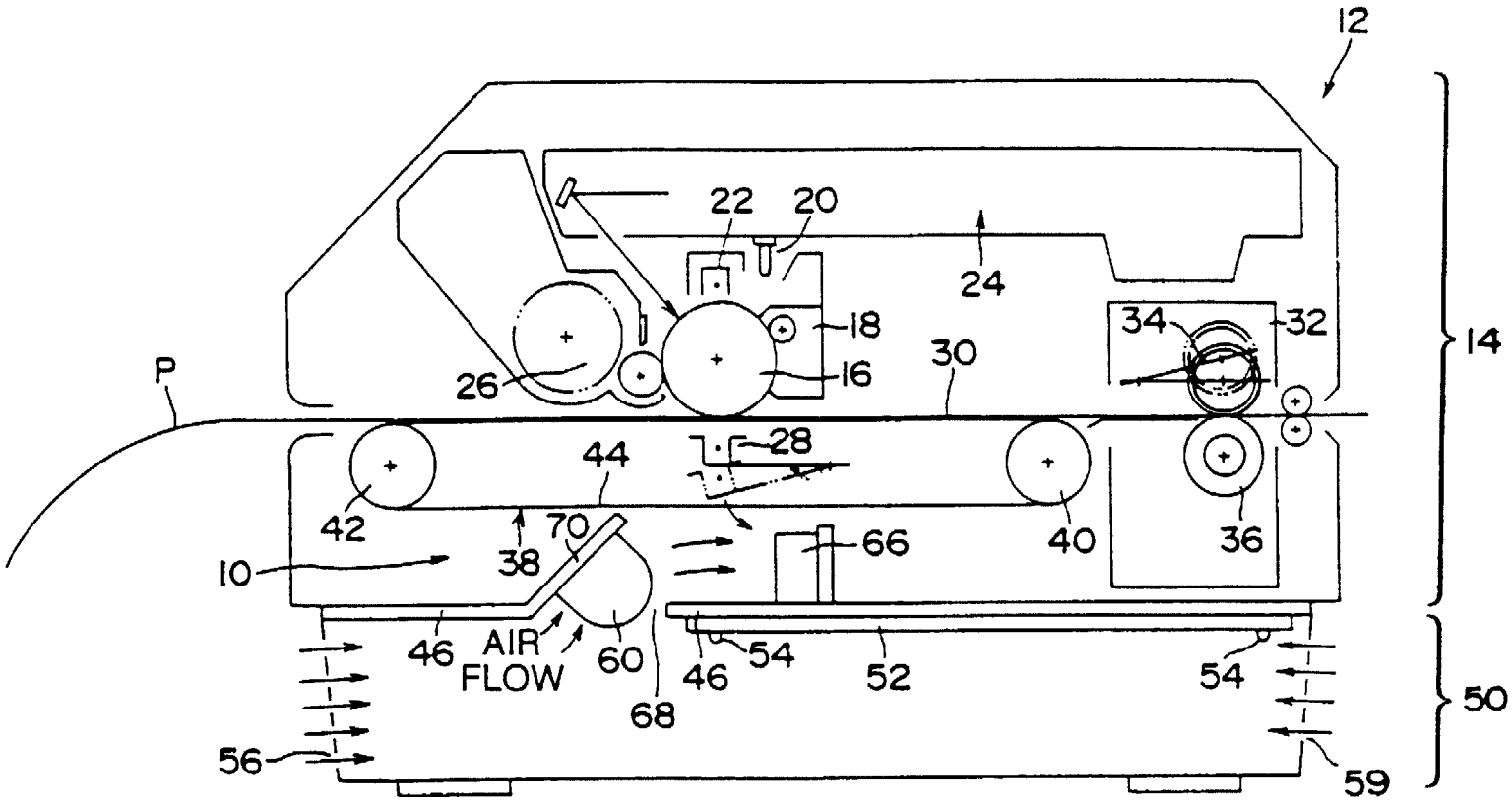
FIG. 2 is a side view of a second embodiment of the present invention.
Figure 3:
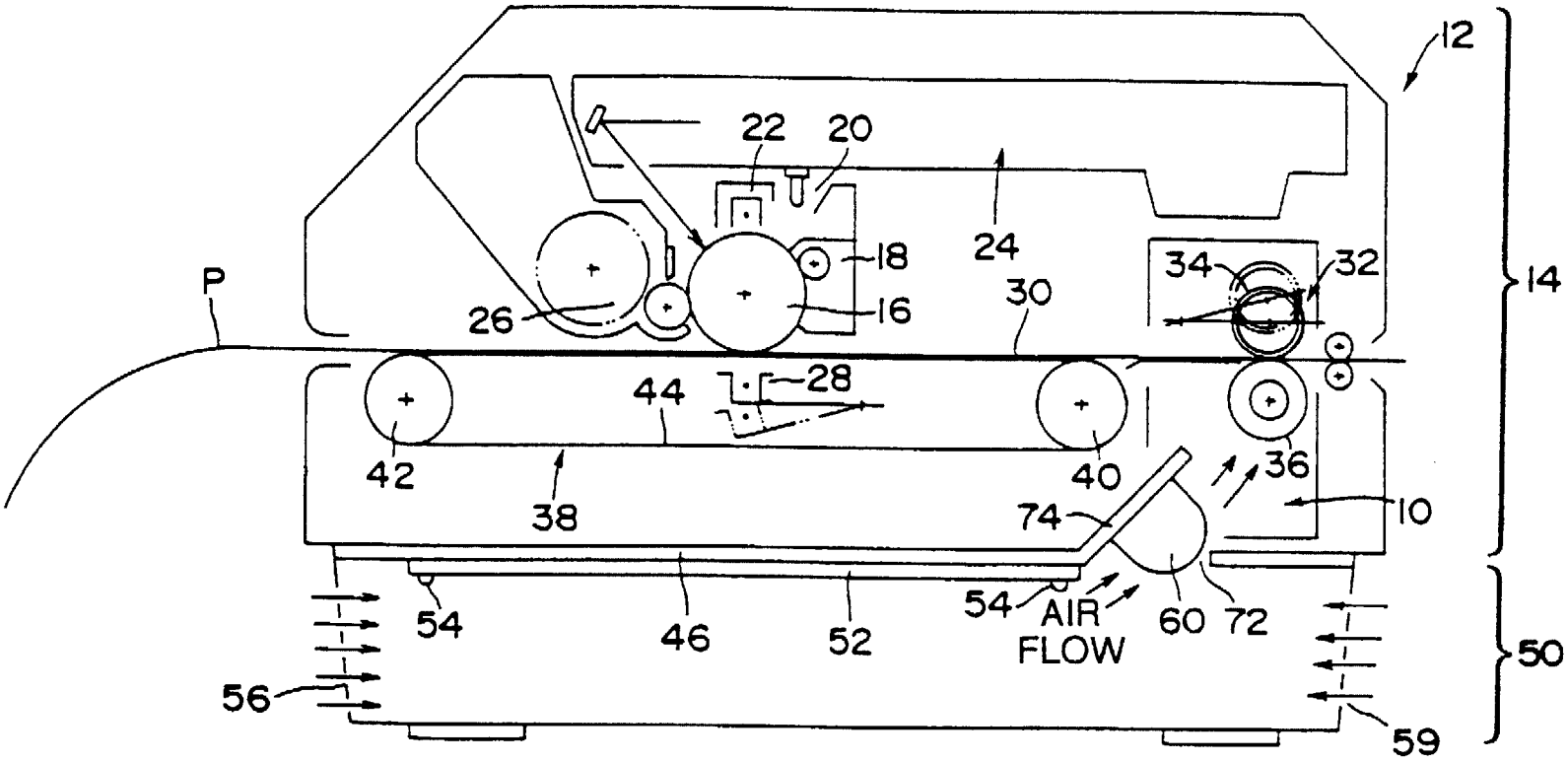
FIG. 3 is a side view of a third embodiment of the present invention.

FIGS. 1 to 3 each show an electrophotographic apparatus using an embodiment of the present invention. In each of FIGS. 1 to 3, a fan system of the present invention is applied to a fan-fold continuous-form laser beam printer 12. The laser-beam printer may take character or image information from a computer or other device and print the image on a continuous sheet P.

The printer 12 includes a housing 14 and base region 50 separated by a divider plate 46. A photoconductive drum 16 is rotatably mounted in the housing 14. The photoconductive drum 16 is driven to rotate at a predetermined rotational speed by a main motor (not shown). The elements of the image formation process are arranged around the drum 16 in counter-clockwise order as follows: a toner cleaning unit 18 for removing toner remaining on the photoconductive surface of the photoconductive drum 16, a discharging unit 20 for removing the charge on the photoconductive drum 16, a charging unit 22 for uniformly charging the photoconductive surface of the drum 16, a laser scanning unit 24 for selectively applying a laser beam to the surface of the photoconductive drum 16, a developing unit 26 for applying toner to a latent image formed on the photoconductive drum 16 by the laser scanning unit 24, and a transfer unit 28 for transferring a toner image formed on the photoconductive drum 16 onto the fan-fold sheet P. As shown, the clockwise direction is the rotational direction R of the photoconductive transfer drum 16. The image formation process uses each of the described elements 16, 18, 20, 22, 24, and 26, for forming images on the continuous sheet P.

The transfer unit 28 may be swung by a swinging mechanism to move the transfer unit 28 between operative and retracted positions, i.e., toward and away from the photoconductive drum 16 and sheet P. In FIGS. 1 to 3, the retracted position is shown by a double dotted line, and the operative position is shown by a solid line.

In each of the schematics of FIGS. 1 to 3, a sheet feed path 30 extends from left to right in the housing 14, passing between the photoconductive drum 16 and the transfer unit 28. A fixing unit 32 including a heat roller 34 and a press roller 36 is positioned downstream of the photoconductive drum 16 along the sheet feed path 30.

During operation, the heat roller 34 is heated to a predetermined temperature by a heating element (not shown). The press roller 36 has a resilient coating and is pressed against the heat roller 34. The resilient coating may be silicon rubber or the like. The heat roller 34 is driven by a drive source (not shown) and the press roller 34 rotates synchronously with the heat roller 34 by a transmission mechanism (not shown).

The heat roller 34 may be moved between fixing and retracted positions, i.e., toward and away from the press roller 36. In FIGS. 1 to 3, the retracted position is shown by a double dotted line, and the fixing position by a solid line. In the fixing position, a predetermined pressure is generated between the heat roller 34 and the pressure roller 36, and an unfixed toner image on the continuous sheet P may be heat-pressed between the pair of rollers 34, 36 to fix the image.

The tractor 38 includes tractor rollers 40 and 42, and an endless tractor belt 44. The tractor belt 44 has a plurality of tractor pins (not shown) arranged to match a corresponding plurality of sprocket holes on each lateral side of the continuous sheet P.

At the entry of the sheet feed path 30, a fan-fold stacker (not shown) may be attached to the housing 14. The continuous sheet may be fed from the stacker through the printer 12 along the sheet feed path 30, and may then be discharged into a detachable discharge tray (not shown) at the exit of the sheet feed path 30.

An electronic controller 52 for controlling the elements of the image formation apparatus is positioned in the base region 50 and attached to the divider plate 46 by bolts 54, 54.

FIG. 1 shows a first embodiment of the present invention. In the first embodiment, vacuum devices 62 and 64 each have an upstream and downstream air flow side. The entry-side vacuum device 62 attracts the continuous sheet P on its upstream side, and removes the ozone generated by the transfer unit 28 on its downstream side. The exit-side vacuum device 64 similarly attracts the continuous sheet P on its upstream side, but instead cools a fixing unit 32 on its downstream side. Each of vacuum devices 62 and 64 therefore has a dual benefit.

The vacuum devices 62 and 64 are mounted between the tractor rollers 40 and 42. The vacuum devices 62 and 64 each attract the continuous sheet P in the direction of the tractor belt 44, to ensure proper alignment and feeding of the continuous sheet P. An ozone filter 66, to remove ozone generated by the transfer unit 28, is located on the downstream side of the entry-side vacuum device 62 in the housing 14 and is, fixed to the divider plate 46.

The entry-side vacuum device 62 includes a duct 62*b* and a suction fan 62*c* disposed in the duct 62*b*. The duct 62*b* has an intake opening 62*a* directed at the continuous sheet P, a secondary opening 62*e* directed at the transfer unit 28, and an exhaust opening 62*d* directed at the ozone filter 66. The secondary intake opening 62*e* is positioned to attract ozone-bearing air generated by the transfer unit 28. The suction fan 62*c* generates a negative air pressure at the intake opening 62*a*, attracting the continuous sheet P in the direction of the tractor belt 44. The air drawn from the intake opening 62*a* by the suction fan 62*c* is then used to remove ozone generated by the transfer unit 28. The fan 60 forces the air through the duct 62*b*, the exhaust opening 62*d*, and the ozone filter 66. The air stream generated by the suction fan 62*c* creates a low-pressure Bernoulli effect at the secondary intake opening 62*e*, attracts the ozone-bearing air generated by the transfer unit 28 into the air stream, and forces the ozone-bearing air through the ozone filter 66. The air thereafter follows a conventional discharge path out of the printer.

The exit-side vacuum device 64 includes a duct 64*b* and a suction fan 64*c*. The duct 64*b* has an intake opening 64*a* directed at the continuous sheet P to attract the continuous sheet P, and an exhaust opening directed at the fixing unit 32 to cool the fixing unit 32. The suction fan 64*c* attracts the continuous sheet P by generating a negative pressure at the intake opening 64*a*. The air drawn from the intake opening 64*a* by the suction fan 64*c* is then used to cool the fixing unit 32. The suction fan 64*c* forces the air through the duct 64*b* and the exhaust opening 64*d*, and towards the fixing unit 32. The air thereafter follows a conventional discharge path out of the printer.

An air intake port 56 and an air exhaust port are formed in the sides of the base region 50. A cooling fan 60 attached under the divider plate 46 cools the controller by forcing air flow from the intake port 56, over the controller 52, and out of the exhaust port 58.

In the first embodiment, as described, the entry-side vacuum device 62 acts both to attract the continuous sheet P and to remove the ozone generated by the transfer unit 28. Furthermore, the exit-side vacuum device acts both to attract the continuous sheet P and to cool the fixing unit 32. It is therefore not necessary to include dedicated fans to remove ozone and cool the fixing unit respectively. Thus, the first embodiment can reduce the number of fans required, and thereby the cost of the printer and the noise generated by fans, when compared to a conventional printer with dedicated fans for ozone removal and for cooling a fixing unit.

FIG. 2 shows the second embodiment of the present invention. In the second embodiment, a fan 60 has a different benefit on each of its upstream and downstream sides. The fan 60 both cools the controller 52 on its upstream side, and removes ozone generated by the transfer unit 28 on its downstream side.

In the second embodiment, the air intake port 56 of the first embodiment is similarly formed in one side of the base region 50. However, a second air intake port 59 is formed in the opposite side of the base region 50, and is shown on the right side of FIG. 2. The air drawn into the base region 50 through the second air intake port 59 flows over the controller 52, cooling the controller 52. A hole 68 is formed in the divider plate 46 near to the transfer unit 28, and an upwardly inclined air guide plate 70 is provided adjacent to the hole 68. A fan 60 is mounted in the region of the hole 68, and forces air, guided by the air guide plate 70, towards an ozone filter 66. Air drawn from the first intake port 56 is forced directly into the housing 14, while air drawn from the second air intake port 59 first cools the controller 52 as described. The ozone filter 66, for removing ozone generated by the transfer unit 28, is fixed to the divider plate 46 on the downstream side of the fan 60.

The fan 60 and the ozone filter 66 are positioned so that the downstream air flow attracts ozone-bearing air generated by the transfer unit 28. The air stream generated by the fan 60 creates a low-pressure Bernoulli effect, attracts the ozone-bearing air generated by the transfer unit 28 into the air stream, and forces the ozone-bearing air through the ozone filter 66. The air thereafter follows a conventional discharge path out of the printer.

As described, in the second embodiment of the present invention, the fan 60 acts both to cool the controller 52 and to remove ozone generated by the transfer unit 28. Dedicated fans for each purpose are therefore not necessary. Thus, the second embodiment can reduce the number of fans required, and thereby the cost of the printer and the noise generated by fans, when compared to a conventional printer with dedicated fans for ozone removal and for cooling a controller.

FIG. 3 shows the third embodiment of the present invention. In the third embodiment, the fan 60 cools the controller 52 on its upstream side as in the second embodiment, but instead cools the fixing unit 32 on its downstream side.

In the third embodiment, air intakes 56 and 59 are positioned as in the second embodiment. However, a hole 72 is instead formed in the divider plate 46 near to the fixing unit 32. The hole 72 and an inclined air guide plate 74 define an air flow path from the base region 50 into the housing 14, and towards the fixing unit 32.

In the third embodiment, the air drawn into the base region 50 through the first air intake port 56 flows over the controller 52, and cools the controller 52. Air from both intake ports 56 and 59 is then forced into the housing 14 by the fan 60.

Once forced into the housing 14 by the fan 60, the air, guided by the inclined air guide plate 74, cools the fixing unit 32. The air thereafter follows a conventional discharge path out of the printer.

In the third embodiment, the fan 60 acts both to cool the controller 52 and to cool the fixing unit 32. Dedicated fans for each purpose are therefore not necessary. Thus, the third embodiment can reduce the number of fans required, and thereby the cost of the printer and the noise generated by fans, when compared to a conventional printer with dedicated fans for cooling a controller and for cooling a fixing unit.

Thus, the described embodiments of the present invention each reduce the number of fans required, when compared to a conventional printer with dedicated fans for several purposes. The cost of the printer and the noise generated by fans may be reduced thereby. Further, the described embodiments reduce the amount of space required for fans and the power consumed by fans in the printer.

The present disclosure relates to a subject matter contained in Japanese Utility Model Application No. HEI 5-44659, filed on Jul. 23, 1993, which is expressly incorporated herein by reference in its entirety.

What is claimed is:

1. An electrophotographic apparatus having a fan system for simultaneously inducing air flow over or through at least two components of a set of components of said electrophotograph apparatus, said set of components at least comprising:

means for forming an image on a sheet; and means for fixing said image, formed by said image forming means, onto said sheet, said fan system for inducing air flow comprising a fan for generating an upstream air flow and a downstream air flow, said fan being arranged so that at least a first component of said set of components of said electrophotographic device is disposed in said upstream air flow of said fan, and so that at least a second component of said set of components of said electrophotographic device is disposed in said downstream air flow of said fan, whereby said fan system simultaneously induces air flow over or through at least each of said first and second components of said set of components of said electrophotographic apparatus; and said sheet being disposed in said upstream air flow, and said upstream air flow drawing said sheet in the direction of said upstream air flow.

2. The electrophotographic apparatus according to claim 1, said downstream air flow cooling said first component of a set of components of said electrophotographic apparatus.

3. The electrophotographic apparatus according to claim 1, said upstream air flow cooling said second component of a set of components of said electrophotographic apparatus.

4. The electrophotographic apparatus according to claim 1, said downstream air flow carrying a byproduct, generated by one component of said set of components of said image forming apparatus, into a filter.

5. An electrophotographic apparatus having a fan system for simultaneously inducing air flow over or through at least two components of a set of components of said electrophotograph apparatus, said set of components at least comprising:

means for forming an image on a sheet;

means for fixing said image, formed by said image forming means, onto said sheet, said fan system for inducing air flow comprising a fan for generating an upstream air flow and a downstream air flow, said fan being arranged so that at least a first component of said set of components of said electrophotographic device is disposed in said upstream air flow of said fan, and so that at least a second component of said set of components of said electrophotographic device is disposed in said downstream air flow of said fan, whereby said fan system simultaneously induces air flow over or through at least each of said first and second components of said set of components of said electrophotographic apparatus;

a sheet feed path, for guiding a sheet through said image forming means and said image fixing means; and a sheet feeding device disposed to feed a sheet along said sheet feed path and through said image forming means and said image fixing means, said first component disposed in said upstream air flow comprising said sheet feeding device, said upstream air flow of said fan drawing said sheet towards said sheet feeding device by inducing air flow over said sheet as said sheet is fed by said sheet feeding device.

6. The electrophotographic apparatus according to claim 5, said second component disposed in said downstream path comprising said fixing means, said fan acting as a cooling device to cool said fixing means by inducing air flow over said fixing means.

7. The electrophotographic apparatus according to claim 5, said downstream air flow cooling said second component of a set of components of said electrophotographic apparatus.

8. The electrophotographic apparatus according to claim 5, said downstream air flow carrying a byproduct, generated by one component of said set of components of said image forming apparatus, into a filter.

9. An electrophotographic apparatus having a fan system for simultaneously inducing air flow over or through at least two components of a set of components of said electrophotograph apparatus, said set of components at least comprising:

means for forming an image on a sheet; and means for fixing said image, formed by said image forming means, onto said sheet, said fan system for inducing air flow comprising a fan for generating an upstream air flow and a downstream air flow, said fan being arranged so that at least a first component of said set of components of said electrophotographic device is disposed in said upstream air flow of said fan, and so that at least a second component of said set of components of said electrophotographic device is disposed in said downstream air flow of said fan, whereby said fan system simultaneously induces air flow over or through at least each of said first and second components of said set of components of said electrophotographic apparatus; and at least a third component of said set of components of said electrophotographic device being disposed in a location adjacent to said downstream air flow path and before said second component in said downstream air flow path, whereby air is induced to flow over or through said third component and to enter said downstream air flow path by virtue of the proximity of said third component to said downstream air flow path and the generation of a low air pressure region, having a lower than ambient air pressure, in said downstream air flow path.

10. The electrophotographic apparatus according to claim 9, said third component of said set of components of said electrophotographic apparatus comprising said image forming means, said image forming means generating ozone, and air flow over said image forming means carrying said ozone into said downstream air flow path.

11. The electrophotographic apparatus according to claim 10, said second component of said set of components of said electrophotographic apparatus comprising an ozone filter for removing ozone from said downstream air flow path as said downstream air flow path flows through said ozone filter.

12. The electrophotographic apparatus according to claim 9, said set of components of said image forming apparatus further comprising a controller, for controlling at least said image forming means and said image fixing means, and said first component disposed in said upstream path comprising said controller, said fan acting as a cooling device to cool said controller by inducing air flow over said controller.

13. The electrophotographic apparatus according to claim 9, said downstream air flow carrying a byproduct, generated by one component of said set of components of said image forming apparatus, into a filter.

14. An electrophotographic apparatus having a fan system for simultaneously inducing air flow over or through at least two components of a set of components of said image forming apparatus, said set of components at least comprising:

means for forming an image on a sheet;

means for fixing said image, formed by said image forming means, onto said sheet;

a sheet feed path, for guiding a sheet through said image forming means and said image fixing means;

a sheet feeding device disposed to feed a sheet along said sheet feed path and through said image forming means and said image fixing means; and a filter, for removing a byproduct generated by at least one component of said set of components of said electrophotographic apparatus, said fan system for inducing air flow comprising a fan for generating an upstream air flow and a downstream air flow, said fan being arranged so that at least said sheet feeding device is disposed in said upstream air flow of said fan, and so that at least said filter is disposed in said downstream air flow of said fan, thereby said fan system simultaneously induces air flow over or through at least each of said sheet feeding device and said filter, and said upstream air flow of said fan drawing said sheet towards said sheet feeding device by inducing air flow over said sheet as said sheet is fed by said sheet.

15. An electrophotographic apparatus having a fan system for simultaneously inducing air flow over or through at least two components of a set of components of said image forming apparatus, said set of components at least comprising:

means for forming an image on a sheet;

means for fixing said image, formed by said image forming means, onto said sheet;

a sheet feed path, for guiding a sheet through said image forming means and said image fixing means;

a sheet feeding device disposed to feed a sheet along said sheet feed path and through said image forming means and said image fixing means; and a filter, for removing a byproduct generated by at least one component of said set of components of said electrophotographic apparatus, and said fan system for inducing air flow comprising a fan for generating an upstream air flow and a downstream air flow, said fan being arranged so that at least said sheet feeding device is disposed in said upstream air flow of said fan, and so that at least said filter is disposed in said downstream air flow of said fan, thereby said fan system simultaneously induces air flow over or through at least each of said sheet feeding device and said filter, and at least said image forming means being disposed in a location adjacent to said downstream air flow path and before said filter along said downstream air flow path, whereby air is induced to flow over or through said image forming means and to enter said downstream air flow path by virtue of the proximity of said image forming means to said downstream air flow path and the generation of a low air pressure region, having a lower than ambient air pressure, in said downstream air flow path.

16. The electrophotographic apparatus according to claim 15, said image forming means generating ozone, and air flow over said image forming means carrying said ozone into said downstream air flow path.

17. The electrophotographic apparatus according to claim 16, said filter comprising an ozone filter.

18. An electrophotographic apparatus having a fan system for simultaneously inducing air flow over or through at least two components of a set of components of said image forming apparatus, said set of components at least comprising:

means for forming an image on a sheet;

means for fixing said image, formed by said image forming means, onto said sheet;

a sheet feed path, for guiding a sheet through said image forming means and said image fixing means; and a sheet feeding device disposed to feed a sheet along said sheet feed path and through said image forming means and said image fixing means, said fan system for inducing air flow comprising a fan for generating an upstream air flow and a downstream air flow, said fan being arranged so that at least said sheet feeding device is disposed in said upstream air flow of said fan, and so that at least said image fixing means is disposed in said downstream air flow of said fan, whereby said fan system simultaneously induces air flow over or through at least each of said sheet feeding device and said image fixing means; and said upstream air flow of said fan drawing said sheet towards said sheet feeding device by inducing air flow over said sheet.

19. The electrophotographic apparatus according to claim 18, said downstream air flow of said fan cooling said image fixing means by inducing air flow over said image fixing means.

20. An electrophotographic apparatus having a fan system for simultaneously inducing air flow over or through at least two components of a set of components of said image forming apparatus, said set of components at least comprising:

means for forming an image on a sheet;

means for fixing said image, formed by said image forming means, onto said sheet;

a controller, for controlling said image forming means and said image fixing means; and a filter, for removing a byproduct generated by at least one component of said set of components of said electrophotographic apparatus, said fan system for inducing air flow comprising a fan for generating an upstream air flow and a downstream air flow, said fan being arranged so that at least said controller is disposed in said upstream air flow of said fan, and so that at least said filter is disposed in said downstream air flow of said fan, whereby said fan system simultaneously induces air flow over or through at least each of said controller and said filter; and at least said image forming means being disposed in a location adjacent to said downstream air flow.

21. The electrophotographic apparatus according to claim 20, said upstream air flow of said fan cooling said controller by inducing air flow over said sheet.

22. The electrophotographic apparatus according to claim 20, said image forming means generating ozone, and air flow over said image forming means carrying said ozone into said downstream air flow path.

23. The electrophotographic apparatus according to claim 22, said filter comprising an ozone filter.

* * * * *

UNITED STATES PATENT AND TRADEMARK OFFICE

CERTIFICATE OF CORRECTION

PATENT NO. : 5,479,242

DATED : December 26, 1995

INVENTOR(S) : T. SATO et al.

It is certified that error appears in the above-indentified patent and that said Letters Patent is hereby corrected as shown below:

At column 6, line 50 (claim 2, line 2), change "downstream" to ---upstream---.

At column 6, line 54 (claim 3, line 3), change "upstream" to ---downstream---.

Signed and Sealed this

Tenth Day of December, 1996

*Attest:*

*Attesting Officer*

Bruce Lehman

BRUCE LEHMAN

*Commissioner of Patents and Trademarks*